US006953887B2

(12) United States Patent
Nagashima et al.

(10) Patent No.: US 6,953,887 B2
(45) Date of Patent: Oct. 11, 2005

(54) SESSION APPARATUS, CONTROL METHOD THEREFOR, AND PROGRAM FOR IMPLEMENTING THE CONTROL METHOD

(75) Inventors: Yoichi Nagashima, Hamamatsu (JP); Yu Nishibori, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 205 days.

(21) Appl. No.: 10/396,646

(22) Filed: Mar. 25, 2003

(65) Prior Publication Data

US 2004/0025670 A1 Feb. 12, 2004

(30) Foreign Application Priority Data

Mar. 25, 2002 (JP) ..... 2002-082830

(51) Int. Cl.[7] ..... G10H 1/18; G10H 7/00

(52) U.S. Cl. ..... 84/645; 84/615; 84/609; 84/622; 84/649; 84/653; 84/659

(58) Field of Search ..... 84/609, 645, 615, 84/622, 649, 653, 659

(56) References Cited

U.S. PATENT DOCUMENTS 6,143,973 A * 11/2000 Kikuchi ..... 84/645

6,353,174 B1 3/2002 Schmidt et al.

6,653,545 B2 * 11/2003 Redmann et al. ..... 84/615

* cited by examiner

*Primary Examiner*—Jeffrey W Donels

(74) *Attorney, Agent, or Firm*—Morrison & Foerster LLP

(57) ABSTRACT

There is provided a session apparatus that enables the user to freely start and enjoy a music session with another session apparatus without being restricted by a time the session should be started. A session apparatus is connected to at least one other session apparatus via a communication network in order to perform a music session with the other session apparatus. Reproduction data to be reproduced simultaneously with reproduction data received from the other session apparatuses is generated and transmitted to the other session apparatus. The reproduction data received from the other session apparatus is delayed by a period of time required for the received reproduction data to be reproduced in synchronism with the generated reproduction data, for simultaneous reproduction of the delayed reproduction data and the generated reproduction data.

8 Claims, 5 Drawing Sheets

SESSION APPARATUS, CONTROL METHOD THEREFOR, AND PROGRAM FOR IMPLEMENTING THE CONTROL METHOD

BACKGROUND OF THE INVENTION

1. Field of the Invention

The present invention relates to a session apparatus that performs a music session with another session apparatus connected thereto via a communication network in real time, a control method for the session apparatus, and a program for implementing the control method.

2. Description of the Related Art

Conventionally, a session apparatus is known which performs a music session with another session apparatus connected thereto via a communication network in real time.

A conventional session apparatus of this kind is disclosed e.g. in the "Minutes of Proceedings of ICMC 97, pp. 446–449, 1997", which starts performance simultaneously with another session apparatus, and performs a music session in synchronism with information of performance given a predetermined time period earlier that in the present performance of its own, which is transmitted from the other session apparatus, thereby eliminating a deviation in timing between the performances due to network delay.

In the above session apparatus, however, to perform a session with the other session apparatus, it is necessary to start performance simultaneously with the other session apparatus, and hence it is impossible for the users of the individual session apparatuses to freely start the music session without being restricted by a time when the session should be started.

SUMMARY OF THE INVENTION

It is an object of the present invention to provide a session apparatus that enables the user to freely start and enjoy a music session with another session apparatus without being restricted by a time when the session should be started, a control method for the session apparatus, and a program for implementing the control method.

To attain the above object, in a first aspect of the present invention, there is provided session apparatus comprising a connection device that connects the session apparatus to at least one other session apparatus via a communication network in order to perform a music session with the other session apparatus, a transmission and reception device that transmits reproduction data to the other session apparatus connected by the connection device, and receives reproduction data transmitted from the other session apparatus, a generation device that reproduction data to be reproduced simultaneously with the reproduction data received by the transmission and reception device, a delay device that delays timing of reproduction of the reproduction data received by the transmission and reception device by a period of time required for the reproduction data received by the transmission and reception device to be reproduced in synchronism with the reproduction data generated by the generation device, and a reproduction device that simultaneously reproduces the delayed reproduction data and the generated reproduction data.

According to this session apparatus, reproduction data received via the transmission and reception device is delayed by a period of time required for the reproduction data received by the transmission and reception device to be reproduced in synchronism with reproduction data generated by the generation device so as to be reproduced simultaneously with the received reproduction data, and the delayed reproduction data and the generated reproduction data are reproduced simultaneously. Therefore, without having to start a music session simultaneously with other session apparatuses, it is possible to perform the music session in synchronism with the other session apparatuses after the lapse of a predetermined time period from the start of performances by the other session apparatuses. This enables the user of each session apparatus to join a music session at a desired time, which greatly enhances the convenience for the users. It should be noted that throughout the specification and claims as hereinafter related, "to reproduce data" is intended to mean "to process data in order to reproduce information (musical tones, images, or the like) represented by the data".

Preferably, the reproduction data composed of packets each having a length corresponding to a predetermined time, and the delay device is responsive to receipt of a packet of reproduction data by the transmission and reception, for delaying timing of reproduction of the received packet of reproduction data until a time point the reproduction device starts to reproduce a packet of reproduction data to be reproduced in synchronism with the received packet of reproduction data.

Preferably, the generation device comprises an automatic generation device that automatically reproduces the reproduction data, and a manual generation device that reproduces-the reproduction data in response to an instruction by a user.

Preferably, the session apparatus further comprises a display device that displays how the reproduction data generated by the session apparatus and the reproduction data received from the other session apparatus are being reproduced, on a session apparatus-by-session apparatus basis.

Preferably, the session apparatus further comprises a configuration device capable of configuring a manner of reproduction of the reproduction data generated by the session apparatus and the reproduction data received from the other session apparatus, on a session apparatus-by-session apparatus basis.

To attain the above object, in a second aspect of the present invention, there is provided a control method of controlling a session apparatus that performs a music session with at least one other session apparatus connected thereto via a communication network, comprising a receiving step of receiving reproduction data transmitted from the other session apparatus via a transmission and reception device, a generating step of generating reproduction data to be reproduced simultaneously with the reproduction data received via the transmission and reception device, a delay step of delaying the reproduction data received via the transmission and reception device by a period of time required for the reproduction data received via the transmission and reception device to be reproduced in synchronism with the reproduction data generated in the generating step, and a reproducing step of simultaneously reproducing the delayed reproduction data and the generated reproduction data.

To attain the above object, in a third aspect of the present invention, there is provided a program for causing a computer to execute the control method described above.

According to these aspects of the invention, the advantageous effects as provided by the first aspect of the invention can be obtained.

The above and other objects, features, and advantages of the invention will become more apparent from the following detailed description taken in conjunction with the accompanying drawings.

DETAILED DESCRIPTION OF THE PREFERRED EMBODIMENTS

The present invention will now be described in detail with reference to the drawings showing a preferred embodiment thereof.

Figure 1:
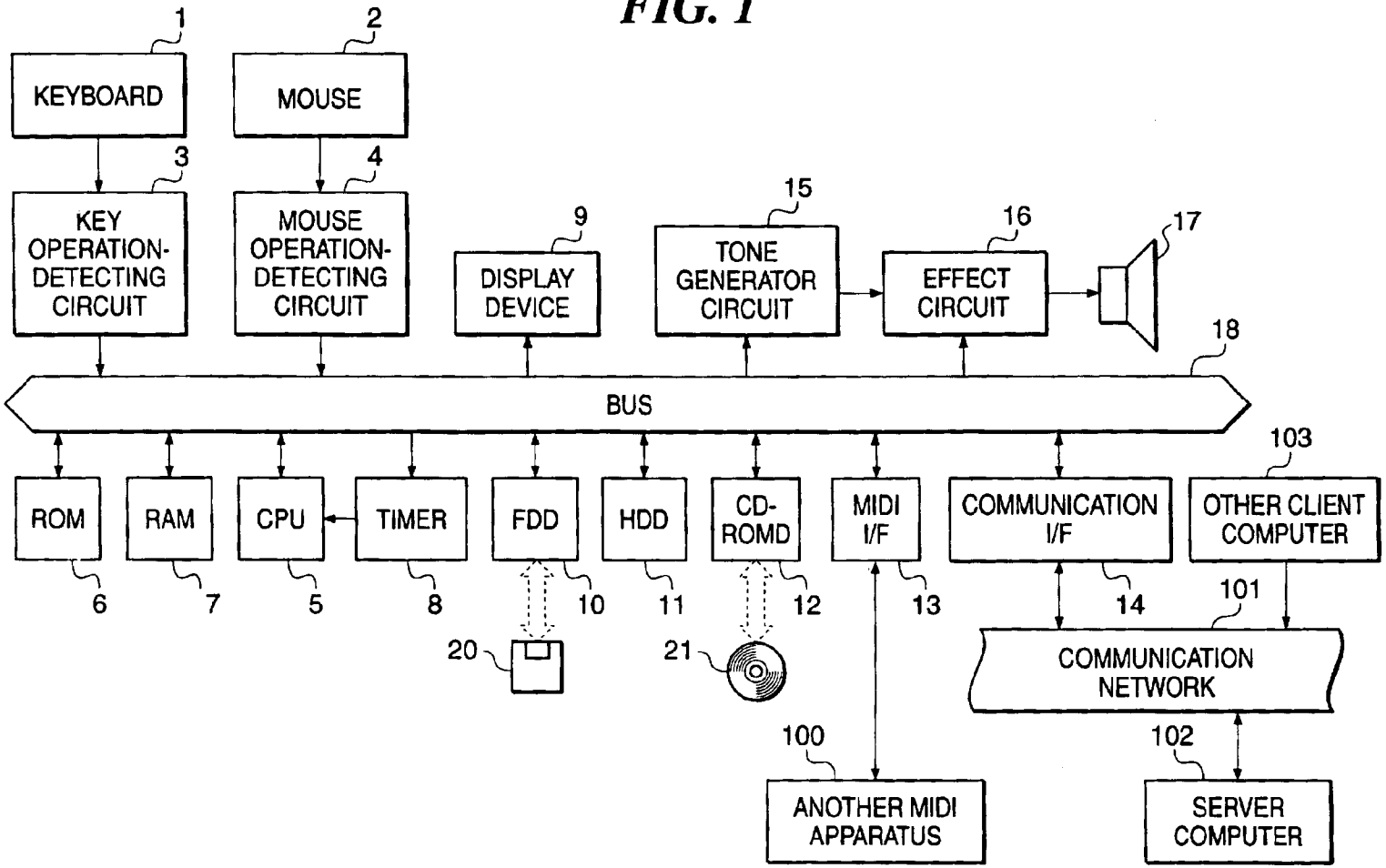
FIG. 1 is a block diagram schematically showing the arrangement of a session apparatus according to an embodiment of the present invention.

FIG. 1 is a block diagram schematically showing the arrangement of a session apparatus according to an embodiment of the present invention.

Referring to FIG. 1, the session apparatus according to the present embodiment is comprised of a keyboard 1 for inputting mainly character information, a mouse 2 serving as a pointing device, a key operation-detecting circuit 3 for detecting operating states of individual keys of the keyboard 1, a mouse operation-detecting circuit 4 for detecting an operating state of the mouse 2, a CPU 5 for controlling the overall operation of the session apparatus, a ROM 6 storing control programs to be executed by the CPU 5, various kinds of table data etc., a RAM 7 for temporarily storing performance data, various kinds of input information, results of arithmetic operations, etc., a timer 8 for measuring a timer interrupt time, and other kinds of times, a display device 9 equipped with e.g. a large-sized liquid crystal display (LCD) or a CRT (Cathode Ray Tube) display and light-emitting diodes (LED's), for displaying various kinds of information, a flexible disk drive (FDD) 10 for driving a flexible disk (FD) 20 as a storage medium, a hard disk drive (HDD) 11 for driving a hard disk, not shown, which stores application programs including the above-mentioned control programs, various kinds of data, and so forth, a CD-ROM drive (CD-ROMD) 12 for driving a compact disk-read only memory (CD-ROM) 21 storing application programs including the above-mentioned control programs, various kinds of data, and so forth, a MIDI (Musical Instrument Digital Interface) interface (IIF) 13 for receiving MIDI data from external apparatuses and outputting MIDI data to external apparatuses, a communication interface (I/F) 14 for transmitting and receiving data to and from, for example, a server computer 102 and other client computers 103 via a communication network 101, a tone generator circuit 15 for converting performance data input via the MIDI I/F 13 or the communication I/F 14, preset performance data, etc., into musical tone signals, an effect circuit 16 for applying various types of effects to musical tone signals received from the tone generator circuit 15, and a sound system 17 for converting musical tone signals received from the effect circuit 16 into sound, including e.g. a DAC (Digital-to-Analog Converter), an amplifier, and a loud speaker.

The above component elements 3 through 16 are connected to each other via a bus 18. The timer 8 is connected to the CPU 5, the MIDI I/F 13 to another MIDI apparatus 100, the communication I/F 14 to the communication network 101, the tone generator circuit 15 to the effect circuit 16, and the effect circuit 16 to the sound system 17. It should be noted that in the present embodiment, the MIDI I/F 13 is connected to a keyboard device as the other MIDI apparatus 100.

In the hard disk of the HDD 11, as stated above, the control programs to be executed by the CPU 5 can be also stored. When a control program is stored in the hard disk, even if the control program is not stored in the ROM 6, and the CPU 5 reads the control program from the hard disk into the RAM 7 to perform the same operation as when the control program is stored in the ROM 6. This facilitates, for example, installation of an additional control program, version upgrade of an existing control program.

The control programs and various kinds of data read from the CD-ROM 21 of the CD-ROM drive 12 are stored in the hard disk of the HDD 11. This facilitates, for example, installation of a new control program, and version upgrade of an existing control program. It should be noted that not only the CD-ROM drive 12 but also a magnet-optical disk (MO) device and/or any other device(s) enabling utilization of one or more of various types of mediums may be provided as an external storage device.

The communication I/F 14 is connected to the communication network 101, such as a LAN (Local Area Network), the Internet, and a telephone line, as described above, and hence the present session apparatus can connect to the server computer 102 via the communication network 101. If any of the programs and various kinds of parameters is not stored in the hard disk in the HDD 11, the communication I/F 14 is used to download such program(s) and/or parameter(s) from the server computer 102. In this case, a computer (the session apparatus in the present embodiment), which is a client, transmits a command requesting to download the program(s) and/or parameter(s), to the server computer 102 via the communication I/F 14 and the communication network 101. Responsive to this command, the server computer 102 distributes (transmits) the requested program(s) and/or parameter(s) to the computer via the communication network 101, and the computer receives the program(s) and/or parameter(s) via the communication I/F 14 to store the same in the hard disk of the HDD 11, thereby completing the downloading.

In addition to these devices, the session apparatus may be equipped with an interface for direct exchange of data with an external computer, etc.

As is understood from the above configuration, the session apparatus according to the present embodiment is constructed on a general-purpose personal computer. However, the session apparatus should by no means be limited to this illustrated example, and may be constructed on a dedicated apparatus formed of only a minimum required number of components essential to implement the present invention.

Figure 2:
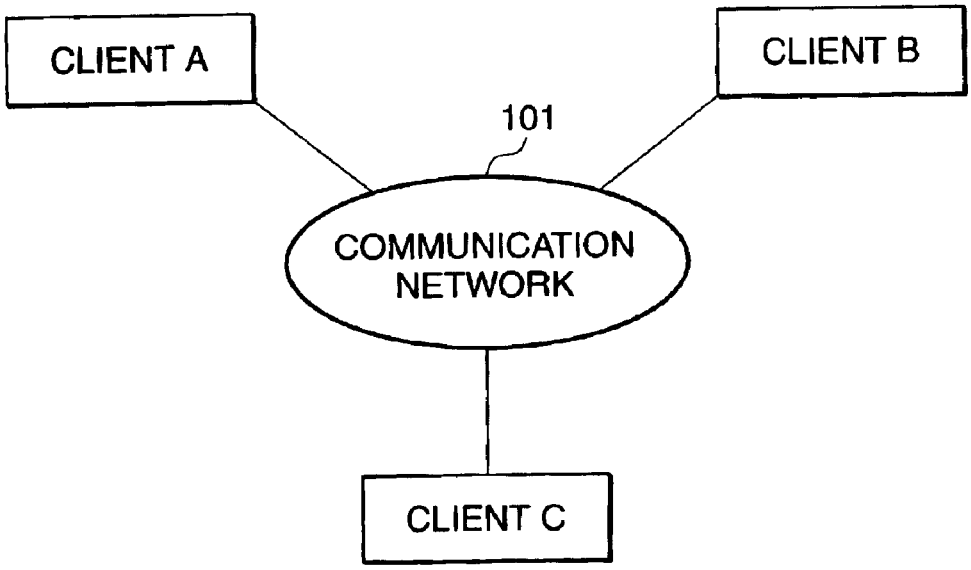
FIG. 2 is a block diagram showing an example of the configuration of a system in which the FIG. 1 session apparatus performs a music session with other session apparatuses.

FIG. 2 is a block diagram showing an example of the configuration of a system that enables the session apparatus according to the present embodiment to perform a music session with other session apparatuses.

As shown in the figure, session apparatuses including the session apparatus according to the present embodiment are connected to each other as clients via the communication network 101. In the present embodiment, the clients A to C operate independently of each other without a master/slave relationship therebetween. It is assumed here, only for convenience of description, that the client A corresponds to the session apparatus according to the present embodiment, and the clients B and C correspond to the other session apparatuses. Further, the clients B and C may have the same hardware configuration as that of the client A, that is, the arrangement illustrated in FIG. 1, or may have a different hardware configuration of their own. More specifically, the clients B and C may have any hardware configuration so long as it enables the clients B and C to perform a music session with the client A, according to an operating procedure described hereinafter.

When the client A transmits data to the client B as one of the other clients, the client A designates the address of the client B on the communication network 101 (e.g. IP address in the case of the communication network 101 being the Internet), and transmits the data to the address. It should be noted that a method of transmitting and receiving data between the clients, etc. will be described hereinafter.

Further, the above configuration of the system including the session apparatuses is described only by way of example, and the number of clients may be larger or smaller than the above number of three (however, at least two clients are necessary for performing a music session). Furthermore, the system may be configured such that the clients A to C have a master/slave relationship. Alternatively, the system may be constructed as a server/client system by providing a server unit for the clients.

Figure 3:
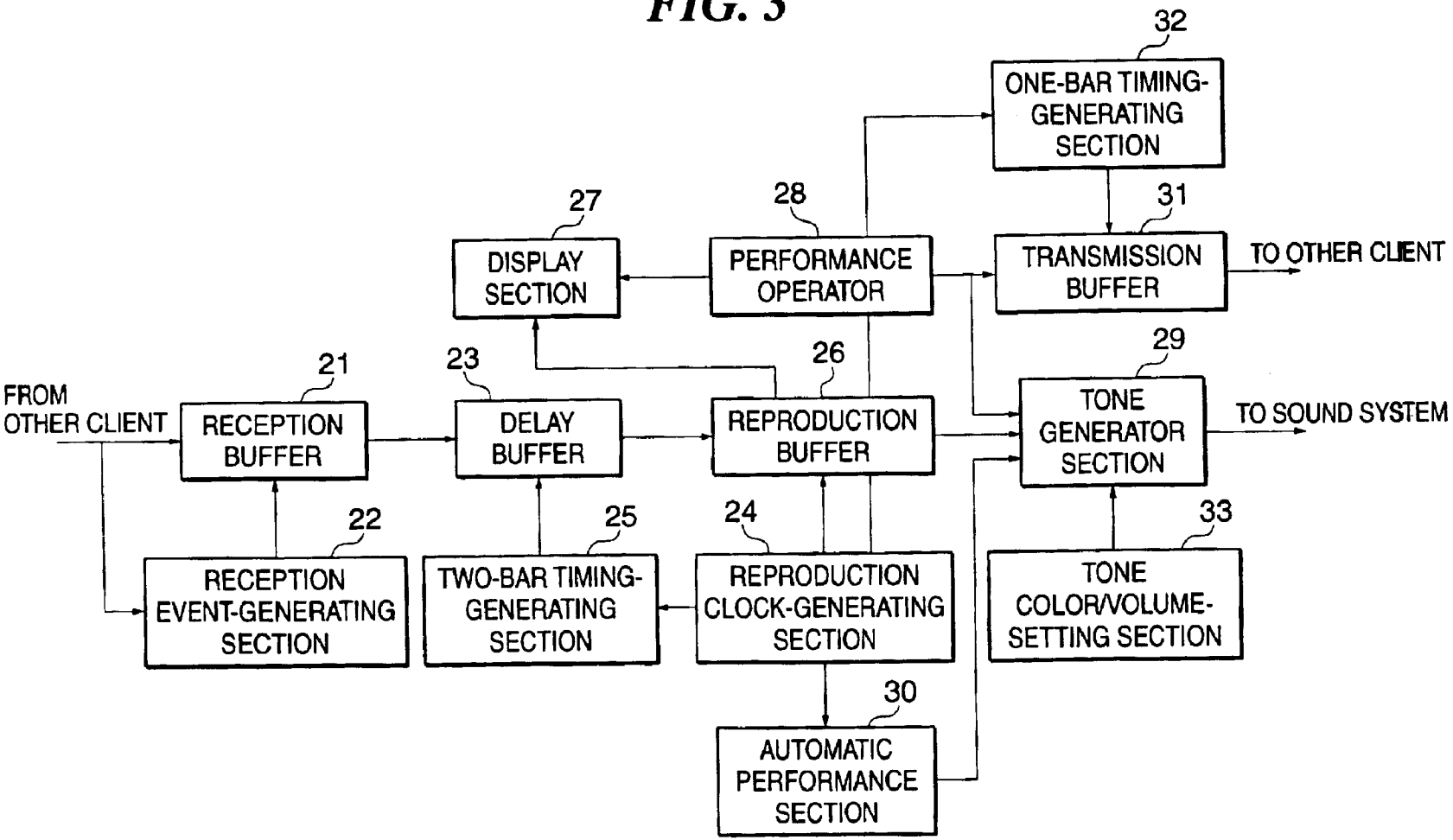
FIG. 3 is a block diagram showing the configuration of functional sections of the FIG. 1 session apparatus according to the present embodiment.
Figure 4:
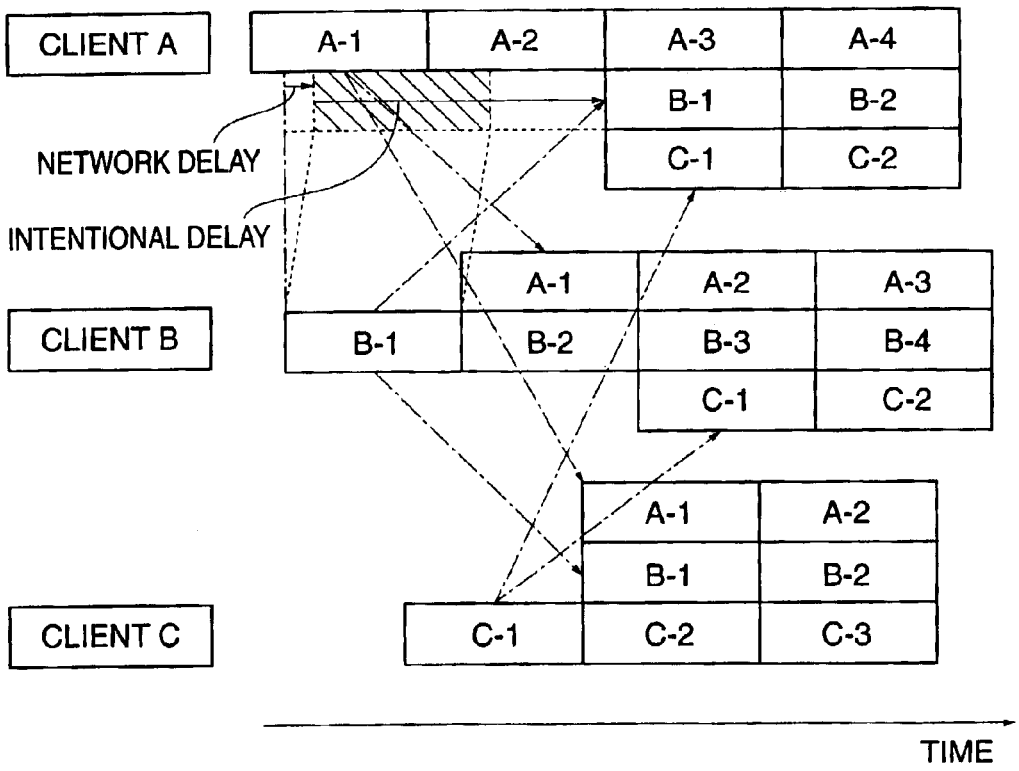
FIG. 4 is a diagram showing an example of a manner of a music session being performed by clients A to C appearing in FIG. 2.
Figure 5:
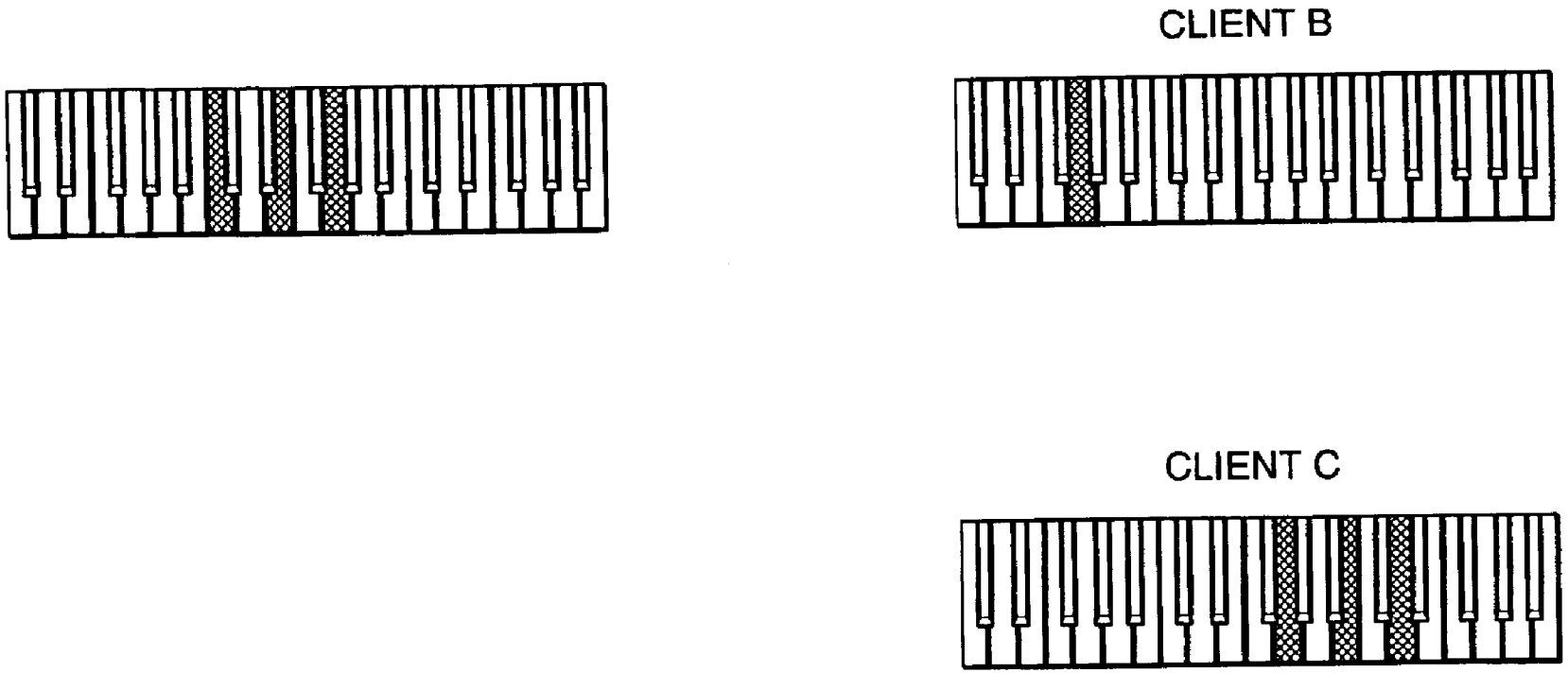
FIG. 5 is a diagram showing an example of images displayed on a display device appearing in FIG. 3.

Now, a control process carried out by the session apparatus constructed as above will be first described in outline with reference to FIG. 2, and then in detail with reference to FIGS. 3 to 5.

The session apparatus according to the present embodiment, i.e., the client A, is configured such that when it performs a music session with the other session apparatuses, i.e., the clients B and C, it can perform the music session without having to start the session simultaneously with the clients B and C. The gist of the present invention consists in this configuration of the session apparatus.

Let it be assumed, for example, that the client A starts performance for a music session first, the client B starts performance for the session next, and the client C starts performance for the session latest. First, the client A designates the addresses of the clients B and C on the communication network 101, as stated above, and starts performance for the session. Although various methods of performing a music session can be envisaged, the client A employs, for example, a method of giving performance by using the keyboard device in real time. Performance data (MIDI data, for example) inputted by performance thus given in real time are sequentially stored in a transmission buffer allocated on the RAM 7. After the performance data has been stored in an amount corresponding to a predetermined time length, e.g. an amount corresponding to the length of one bar, a packet of the performance data having a length corresponding to the length of one bar is formed and transmitted to the clients B and C.

Next, when the clients B and C start performance for the music session, packets of performance data having a length corresponding to one bar are similarly transmitted respectively from the clients B and C to the client A, so that the client A sequentially stores the packets in a reception buffer allocated on the RAM 7. After amounts of performance data each corresponding to the length of two bars have been stored in the reception buffer, the client A moves (or copies) the performance data to a delay buffer provided in a region other than the reception buffer, allocated on the RAM 7.

Then, the client A moves (or copies) the above-mentioned amount of performance data corresponding to the length of two bars, stored in the delay buffer, to a reproduction buffer allocated on the RAM 7 in timing (two-bar timing) in which the current reproduction of performance data corresponding to the length of two bars is completed. The performance data stored in the reproduction buffer, that is, the performance data in the amount corresponding to the length of two bars is reproduced according to a reproduction clock having a repetition period corresponding to a tempo set in advance (the same tempo is set for the clients B and C as well). It should be noted that the above two-bar timing is detected by counting the reproduction clock a predetermined number of times (number of times corresponding to the length of two bars).

The reproduced performance data is supplied to the tone generator circuit 15, and performance data inputted from the keyboard device is also supplied to the tone generator circuit 15, so that the tone generator circuit 15 generates musical tone signals from the performance data received from the clients B and C and the performance data from the client A, which are synchronized with each other.

Thus, the user of the client A can enjoy a music session synchronized on a client-by-client basis without having to start performance for the session simultaneously with the users of the clients B and C.

Next, the above control process will be described in detail.

FIG. 3 is a block diagram showing the configuration of functional sections of the session apparatus according to the present embodiment.

When the session apparatus receives packets of performance data having a length corresponding to one bar, transmitted from the other clients, that is, the clients B and C, a reception event-generating section 22 generates reception events, and in response to the reception events, the received performance data is stored in the reception buffer 21. As described above, the reception buffer 21 is allocated on the RAM 7, i.e. provided in a predetermined location of the RAM 7, and different areas in the reception buffer 21 are allocated for the other clients, respectively.

When the reception event-generating section 22 generates reception events from the same one of the other clients twice, that is, when an amount of performance data corresponding to the length of two bars is received from the same client, the performance data is read out from the reception buffer 21 and stored in the delay buffer 23. The delay buffer 23 is also allocated on the RAM 7, i.e. provided in a predetermined location thereof, as described above, and different areas in the delay buffer 23 are allocated for the other clients, respectively. It should be noted that each packet having a length corresponding to one bar may be configured to contain information indicative of whether the packet corresponds to the first half or the second half of performance data corresponding to two bars.

The performance data is formed of MIDI data, for example, which is constituted by a sequence of events and timing (timing in which immediately following events should be reproduced). Therefore, to reproduce the performance data, it is necessary to detect reproduction timing in which each event should be reproduced. For this reason, the reproduction clock is generated by a reproduction clock-generating section 24, and by counting, e.g. rises of the reproduction clock, the reproduction timing is detected. It is configured such that the repetition period of the reproduction clock usually varies with the tempo, and hence it is necessary to set the tempo in advance. In the present invention, one client performs a music session in synchronism with other clients, which requires the same tempo to be set for all the clients. To set the same tempo for all the clients, there can be envisaged a method of detecting groups of clients performing music sessions to obtain information of names of the groups, tempo, etc., and displaying a list of the groups together with the above information, so that when the user of the client A designates from the list a music session in which he/she wants to participate, the tempo of the music session is automatically set for the client A, or when a session in which the user feels like participating is not found in the list of groups and the user wants to start a new session, the user can freely set tempo to register the tempo as the tempo of the music session. Further, the system may be configured such that the tempo can be changed as desired during performance of a music session. In this case, there can be employed a method, for example, in which if the user of the client A transmits a request for a change in tempo to the other clients B and C and the users of the other clients B and C agree to the request, the tempos of the clients A to C are simultaneously changed.

The reproduction clock generated by the reproduction clock-generating section 24 is supplied to the reproduction buffer 26 and a two-bar timing-generating section 25. The two-bar timing-generating section 25 counts, e.g. rises of the supplied reproduction clock to thereby generate a signal (two-bar timing signal) indicative of timing in which readout (reproduction) of the performance data corresponding to the length of two bars from the reproduction buffer 26 should be terminated.

When the two-bar timing signal is generated from the two-bar timing-generating section 25, this signal is supplied to the delay buffer 23. In response to the two-bar timing signal, the amount of performance data corresponding to the length of two bars to be reproduced next is read out from the delay buffer 23, and stored in the reproduction buffer 26.

The reproduction buffer 26 counts the supplied reproduction clock, and whenever reproduction timing is reached, the reproduction buffer 26 has a corresponding event read therefrom and the read event is delivered to a tone generator section 29 (corresponding to the tone generator circuit 15 and the effect circuit 16 appearing in FIG. 1).

Further, the reproduction clock generated by the reproduction clock-generating section 24 is also supplied to an automatic performance section 30 and a one-bar timing-generating section 32. The session apparatus according to the present embodiment is configured such that not only real-time play with the keyboard device but also automatic performance (automatic accompaniment) is performed. Accompaniment data (composed of a sequence of events and timing) for the automatic performance is also stored in the RAM 7 and the ROM 6. The automatic performance section 30 also reproduces the accompaniment data for the automatic performance in the same manner as the reproduction buffer 26 to supply events of the automatic performance to the tone generator section 29. It is assumed that the automatic performance is given based on a predetermined chord progression (two five, for example) in units of two bars, and the user performs manual performance such that his performance matches the chord progression of the automatic performance. To the tone generator section 29 are also supplied events inputted by using keys on a performance operator 28, i.e. the keyboard device. The tone generator section 29 generates musical tone signals of tone colors and volumes set by a tone color/volume-setting section 33, based on the supplied events, and delivers the signals to the sound system 17.

The tone color/volume-setting section 33 is configured such that in addition to a tone color and a volume specified by the user for his session apparatus, tone colors and volumes of musical tones to be reproduced based on performance data received from the other clients B and C can be seperately set.

The events inputted from the performance operator 28 are also supplied to a transmission buffer 31. When the one-bar timing-generating section 32 generates a signal indicative of one-bar timing (one-bar timing signal), an amount of performance data corresponding to the length of one bar is read out from the transmission buffer 31 to form one packet, and the one packet is transmitted to the clients B and C. Upon receipt of the performance data from the client A, the clients B and C process the performance data in the same manner as the session apparatus according to the present embodiment, whereby the tone generator section 29 of the clients B and C generates and delivers musical tone signals whose events are synchronized with the events outputted from the performance operator of the clients B and C.

The events read out from the reproduction buffer 26 are also supplied to a display section 27 (corresponding to the display device 9 appearing in FIG. 1). To the display section 27 are also supplied the events inputted from the performance operator 28. As shown in FIG. 5, the display section 27 displays the performance operators of the clients A to C, i.e., the keyboard devices in the present embodiment. The display section 27 displays the respective states of performances being given by the users of the clients A to C, for example, by changing a manner of representation of keys that are depressed, e.g. the color of the depressed keys, on a client-by-client basis. This makes it possible to visually grasp the respective states of performances being given by the users of the other clients as well as the state of a performance being given by the user himself, which further enables comparison between the respective states of performances being given by the clients.

FIG. 4 is a diagram showing, by way of example, how a music session is played by the clients A to C. The illustrated example shows the state of a music session started in the order of the client A, the client B, and the client C, as described hereinabove in outline. It should be noted that each block in FIG. 4 indicates performance data in an amount corresponding to the length of two bars.

In FIG. 4, first, the client A starts a performance A-1 (represented by a block designated by A-1 in FIG. 4; the other performances are similarly represented in the figure), then the client B starts a performance B-1, and finally the client C starts a performance C-1. The performance B-1 reaches the client A (see the hatched square area in FIG. 4) after a certain network delay (the delay time depends on actual conditions of the network). The client A has not completed receiving amounts of performance data each corresponding to the length of two bars from the other clients B and C when the performance A-1 is completed (the performance per se of the other clients B and C for the performance data to be received has not yet been completed). In the client A, after the performance data from the clients B and C have been completely received by the client A, the performance data from the clients B and C are intentionally delayed until a performance A-2 is completed and a performance A-3 is started. First performances B-1 and C-1 by the other clients B and C are started in synchronism with the performance A-3. Accordingly, in the client A, a music session is carried out by the performances A-3, B-1, and C-1. After that, the session is continued with the time difference maintained so long as the other clients B and C continue their performances. However, the time difference can be changed if arrival of the performance data from either of the clients B and C is delayed. It should be noted that "to synchronize" is intended to mean "to make the respective starts of pieces of performance data of the clients A to C coincident with each other". More specifically, in the present embodiment, the start of each piece of performance data is the start of each bar, and hence "to synchronize" means "to make coincident timing in which each piece of performance data starts to be reproduced, with the start of each bar.

In the client B, before the client B completes the performance B-1, the client A has completed his performance over the length of two bars. Hence, when the client B starts the next performance B-2, the performance A-1 is started in synchronism with the performance B-2, whereby the music session is carried out by the performances B-2 and A-1. Further, before the performance B-2 is completed, the client C has terminated his performance over the length of two bars, so that when the next performance B-3 is started, the performance C-1 is started in synchronism with the performance B-3, whereby the music session is carried out by the performances B-3, A-2, and C-1. After that, the session is continued with the time difference maintained so long as the clients A and C continue their performances.

In the client C, since the clients A and B have completed their performances over the length of two bars before the performance C-1 is completed. Hence, when the next performance C-2 is started, the performances A-1 and B-1 are started in synchronism with the performance C-2, whereby the music session is carried out by the performances C-2, A-1 and B-1. After that, the session is continued with the time difference maintained so long as the clients A and B continue their performances.

As described hereinabove, the session apparatus according to the present embodiment is capable of performing a music session in synchronism with the other session apparatuses after the lapse of a predetermined time period (corresponding to the length of four bars at the longest) from the start of performances by the other session apparatuses, without having to start the session simultaneously with the other session apparatuses. This enables the respective users of the session apparatuses to join a music session at a desired time, which greatly enhances the convenience for the users.

Further, since a music session is thus performed by the present performance of the user and the past performances of the users of the other session apparatuses, it is possible to perform an interesting session which cannot be realized by an ordinary session. It should be noted that the performance of each user is given in a manner matched to the chord progression repeated in units of two bars, and hence the user does not feel a sense of disorder even if he/she has a music session with the past performances of the others.

Further, the performances of a music session in which session apparatuses are involved are different between the session apparatuses. More specifically, in the case of the example illustrated in FIG. 4, in the client A, the performance A-3 is given together with the performances B-1 and C-1 in session, while in the client B, the performance A-3 is given together with the performances B-4 and C-2 in session. Thus, even in the same session, different performances are given depending on the session apparatuses, which also makes the users to enjoy an interesting session.

Although in the present embodiment, the case is given by way of example in which the clients A, B, and C are different from each other in the timing of the start of performance, even if the start timing is made to coincide with each other, similarly to the above example, performance data from the clients A, B, and C are intentionally delayed due to network delay, and then reproduced in synchronism with each other.

Although in the present embodiment, performance data concerning performances given in real time by the session apparatuses are transmitted and received between the session apparatuses, the data to be transmitted and received are not limited to performance data, but any data, such as audio data and image data, may be transmitted and received insofar as it makes sense to reproduce the data in a synchronized manner.

Although in the present embodiment, performance data are inputted by using the keyboard device, this is not limitative but any musical instrument may be employed. Further, performance data may be inputted not only by musical instruments but also by various kinds of input devices. For example, a picture of a musical instrument and a cursor may be displayed on the display device 9, and the cursor may be moved e.g. by using the mouse 2 for designating pitch in real time.

Further, although in the present embodiment, inputted performance data are formed into packets in units of the length of one bar for transmission to the other clients, needless to say, the length of data is not limited to a length corresponding to one bar. The length of data for use in reproducing performance data is not limited to a length corresponding to two bars, either, but any data length may be employed insofar as it is of use from a musical point of view.

Further, performance data formed into packets may have a data format in which pitch data is stored in each of a predetermined number (e.g. "16") of divided sections of a predetermined length (e.g. corresponding to one bar) of the performance data.

It is to be understood that the object of the present invention may also be accomplished by supplying a system or an apparatus with a storage medium in which a program code of software which realizes the functions of the above described embodiment is stored, and causing a computer (or CPU 5 or MPU) of the system or apparatus to read out and execute the program code stored in the storage medium.

In this case, the program code itself read from the storage medium realizes the functions of the above described embodiment, and hence the storage medium in which the program code is stored constitutes the present invention.

Examples of the storage medium for supplying the program code include the flexible disk 20, the hard disk, an optical disk, a magnetic-optical disk, the CD-ROM 21, a CD-R, a CD-RW, a DVD-ROM, a DVD-RAM, a DVD–RW, a DVD+RW, a magnetic tape, a nonvolatile memory card, and the ROM 6. As an alternative, the program code may be supplied from the server computer 102 via the other MIDI apparatus 100 and the communication network 101.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into an expansion board inserted into a computer or a memory provided in an expansion unit connected to the computer and then causing a CPU or the like provided in the expansion board or the expansion unit to perform a part or all of the actual operations based on instructions of the program code.

What is claimed is:

1. A session apparatus comprising:

a connection device that connects the session apparatus to at least one other session apparatus via a communication network in order to perform a music session with the other session apparatus;

a transmission and reception device that transmits reproduction data to the other session apparatus connected by said connection device, and receives reproduction data transmitted from the other session apparatus;

a generation device that generates reproduction data to be reproduced simultaneously with the reproduction data received by said transmission and reception device;

a delay device that delays timing of reproduction of the reproduction data sent from the other session apparatus and received by said transmission and reception device by a period of time required for the reproduction data received by said transmission and reception device to be reproduced in synchronism with the reproduction data generated by said generation device of the session apparatus; and a reproduction device that simultaneously reproduces the delayed reproduction data and the generated reproduction data.

2. A session apparatus according to claim 1, wherein the reproduction data is composed of packets each having a length corresponding to a predetermined time, and wherein said delay device is responsive to receipt of a packet of reproduction data by said transmission and reception device, for delaying timing of reproduction of the received packet of reproduction data until a time point said reproduction device starts to reproduce a packet of reproduction data to be reproduced in synchronism with the received packet of reproduction data.

3. A session apparatus according to claim 1, wherein said generation device comprises an automatic generation device that automatically reproduces the reproduction data, and a manual generation device that reproduces the reproduction data in response to an instruction by a user.

4. A session apparatus according to claim 1, further comprising a display device that displays how the reproduction data generated by the session apparatus and the reproduction data received from the other session apparatus are being reproduced, on a session apparatus-by-session apparatus basis.

5. A session apparatus according to claim 1, further comprising a configuration device capable of configuring a manner of reproduction of the reproduction data generated by the session apparatus and the reproduction data received from the other session apparatus, on a session apparatus-by-session apparatus basis.

6. A control method of controlling a session apparatus that performs a music session with at least one other session apparatus connected thereto via a communication network, comprising:

a receiving step of receiving reproduction data transmitted from the other session apparatus via a transmission and reception device;

a generating step of generating reproduction data to be reproduced simultaneously with the reproduction data received via the transmission and reception device;

a delay step of delaying the reproduction data sent from the other session apparatus and received via the transmission and reception device by a period of time required for the reproduction data received via the transmission and reception device to be reproduced in synchronism with the reproduction data generated in said generating step by the session apparatus; and a reproducing step of simultaneously reproducing the delayed reproduction data and the generated reproduction data.

7. A program for causing a computer to execute a control method of controlling a session apparatus that performs a music session with at least one other session apparatus connected thereto via a communication network, the control method comprising:

a receiving step of receiving reproduction data transmitted from the other session apparatus via a transmission and reception device;

a generating step of generating reproduction data to be reproduced simultaneously with the reproduction data received via the transmission and reception device;

a delay step of delaying the reproduction data sent from the other session apparatus and received via the transmission and reception device by a period of time required for the reproduction data received via the transmission and reception device to be reproduced in synchronism with the reproduction data generated in said generating step by the session apparatus; and a reproducing step of simultaneously reproducing the delayed reproduction data and the generated reproduction data.

8. A session apparatus according to claim 1, wherein said delay device delays the timing of reproduction of the reproduction data sent from the other session apparatus and keeps timing of reproduction of the reproduction data generated by said generation device of the session apparatus from being delayed.

* * * * *